US010981400B2

(12) United States Patent
Bridges et al.

(10) Patent No.: US 10,981,400 B2
(45) Date of Patent: Apr. 20, 2021

(54) PRINTERS

(71) Applicant: Domino UK Limited, Cambridge (GB)

(72) Inventors: Richard Thomas Calhoun Bridges, Cambridge (GB); Daniel John Lee, Huntingdon (GB); Juergen Martin, Singen (DE)

(73) Assignee: Domino UK Limited

( * ) Notice: Subject to any disclaimer, the term of this patent is extended or adjusted under 35 U.S.C. 154(b) by 0 days.

(21) Appl. No.: 16/607,411

(22) PCT Filed: May 2, 2018

(86) PCT No.: PCT/GB2018/051171
§ 371 (c)(1),
(2) Date: Oct. 23, 2019

(87) PCT Pub. No.: WO2018/203053
PCT Pub. Date: Nov. 8, 2018

(65) Prior Publication Data

US 2020/0130387 A1 Apr. 30, 2020

(30) Foreign Application Priority Data

May 3, 2017 (GB) ..... 1707044

(51) Int. Cl.
*B41J 25/00* (2006.01)
*B41J 2/02* (2006.01)

(52) U.S. Cl.
CPC ..... *B41J 25/001* (2013.01); *B41J 2/02* (2013.01); *B41J 2002/022* (2013.01)

(58) Field of Classification Search
CPC ..... B41J 25/001; B41J 2/02; B41J 2002/022; B41J 2/03; B41J 13/0009; B41J 2/04508; B41J 2/2132; B41J 29/393
USPC ..... 347/14
See application file for complete search history.

(56) References Cited

U.S. PATENT DOCUMENTS

2004/0155948 A1* 8/2004 Dinca ..... B41J 2/04508 347/104
2017/0104888 A1 4/2017 Nomura

FOREIGN PATENT DOCUMENTS

| | | |
|---|---|---|
| GB | 2398447 | 8/2004 |
| JP | S63154360 | 6/1988 |
| JP | H05138878 | 6/1993 |
| JP | 2014213605 A | 11/2014 |
| JP | 2014213605 A | 11/2014 |

* cited by examiner

*Primary Examiner* — Huan H Tran
*Assistant Examiner* — Alexander D Shenderov
(74) *Attorney, Agent, or Firm* — Price Heneveld LLP

(57) ABSTRACT

A printer (5) operable to print a message in strokes on a substrate (7) passing in a print direction (8) along a moving line (6), wherein the printer is operable (15) to receive an indication of an allowable increase in length in the print direction of a message due to an increase in length in the print direction of gaps between successive strokes printed by the printer, to receive (14) an indication (9) of a speed of movement in the print direction of a moving line, to determine from the indication of the speed of movement of the moving line whether an increase in length in the print direction of a message printed by the printer is greater than the allowable increase in length and, if so, to generate an alert.

9 Claims, 3 Drawing Sheets

PRINTERS

FIELD OF THE INVENTION

This invention relates to a method of, and/or a system for, maintaining print quality. While the system has been devised for providing an indication of print quality in a continuous inkjet printer it will be appreciated that the invention is also applicable to other printing technologies.

BACKGROUND TO THE INVENTION

Continuous inkjet ('CIJ') printers are widely used to place identification codes on products. Typically a CIJ printer includes a printer housing that contains a system for pressurising ink. Once pressurised, the ink is passed, via an ink feed line through a conduit, to a printhead. At the printhead the pressurised ink is passed through a nozzle to form an ink jet. A vibration or perturbation is applied to the ink jet causing the jet to break into a stream of droplets.

The printer includes a charge electrode to charge selected droplets, and an electrostatic facility to deflect the charged droplets away from their original trajectory and onto a substrate. By controlling the amount of charge that is placed on droplets, the trajectories of those droplets can be controlled to form a printed image.

A continuous inkjet printer is so termed because the printer forms a continuous stream of droplets irrespective of whether or not any particular droplet is to be used to print. The printer selects the drops to be used for printing by applying a charge to those drops, unprinted drops being allowed to continue, on the same trajectory as they were jetted from the nozzle, into a catcher or gutter. The unprinted drops collected in the gutter are returned from the printhead to the printer housing via a gutter line included in the same conduit as contains the pressurised ink feed line feeding ink to the printhead. Ink, together with entrained air, is generally returned to the printer housing under vacuum, the vacuum being generated by a pump in the gutter line.

CIJ printers print characters and images broken into strokes, or swaths of drops which, when printed side-by-side, form the required image.

A stroke of print is formed using a raster architecture which defines the number of drops and the print height of a stroke, the vertical slice of a bitmap that defines which drops in the stroke are to be printed, and the application of a raster algorithm that establishes the voltage required at the charge electrode to achieve the required charge on each drop.

The number of drops in a raster stroke, along with the frequency at which the drops are created, dictate how fast a message can be printed and this in turn dictates the maximum print speed on a production line.

When the production line in running at less than the maximum print speed, there will be one or more unprinted drops between each succession of drops used to print a raster stroke. As the speed of the production line increases, the number of unprinted drops between each succession of drops used to print a raster stroke decreases, until at the maximum print speed, there are no unprinted drops between each succession of drops used to print a raster stroke.

The operation of the printer can be synchronised to a moving substrate using a speed sensing device such as an encoder which provides an output in pulses in response to the movement of the production line or substrate. These pulses are received by the printer and used to synchronise the print output. In a typical printer application the encoder increments a counter in the printer which is compared to a target count for the onset of a stroke and, when the two are equal, the stroke is printed.

In industrial marking and coding applications, it is generally the objective to print at the maximum rate possible for the technology used. For CIJ printers the maximum print rate is usually a compromise with print quality.

CIJ printers often include systems which compensate for the time it takes for the charged droplets to travel from the point at which they are charged, to the substrate. This is often termed time-of-flight. An effective time-of-flight system will not just make an adjustment for the start of a printed message (the first stroke), but it will continually make adjustments for subsequent strokes in a printed message—the faster the substrate speed, the more the time-of-flight system advances the start of the stroke.

EP 2 644 384 is concerned with a CIJ printer that can determine an acceleration of a production line and use the acceleration to predict the required interval between raster strokes.

As outlined above, the maximum speed of printing is dictated by the raster length and drop frequency. If the speed of the production line exceeds that at which strokes can be printed, then the onset of a stroke will be delayed until the previous stroke is printed. This results in the appearance of an elongated or stretched print on the substrate in the direction of movement of the line due to the fact that the substrate has moved further than intended from one stroke to the next.

The stretching of the intended print is in effect a degradation of print quality, so it is usual to warn the user when this occurs.

One way of establishing the need to provide this warning is to simply detect if the target encoder count, is less than the current encoder count; that is to say the stroke is late and therefore the print must have stretched.

When printing at any stroke rate, there will come a point when the encoder count is very close to the target encoder count to print the stroke, i.e. the stroke is just about to be printed. In this circumstance, if the time-of-flight system detects an increase in speed and advances the timing accordingly by advancing the encoder count, the stroke will be seen as being late and a stretch alert will be raised when this is not actually the case.

When printing at or close to the maximum speed allowed by the raster, any slight increase in speed, as detected by the encoder, might cause this situation to occur, and therefore warn the user when the print quality has not significantly been affected, this being a nuisance to the user.

Furthermore, since a print consists of many strokes, multiple alerts might be raised at a high rate which could overload software systems.

It is an object of the invention to provide a method of regulating the use of a printer that will go at least some way in addressing the aforementioned problems; or which will at least offer a novel and useful choice.

SUMMARY OF THE INVENTION

Accordingly, in one aspect, the invention provides a method of regulating the operation of a printer printing in strokes on a substrate passing along a moving line in a print direction, said method being characterised in that it includes a user of said printer defining an allowable amount of stretch in said print direction of a message to be printed by said printer.

By "allowable amount of stretch" is meant an allowable increase in length in the print direction of a message due to an increase in length in the print direction of gaps between successive strokes printed by the printer.

Preferably a speed sensing facility is provided giving an output representative of the speed of said moving line, said method comprising defining, in units corresponding to the output of said speed sensing facility, target gaps between strokes in said print direction; defining an allowable stretch in said message; and comparing the outputs of stroke printing events of said speed sensing facility with said target gaps.

Preferably the output of said speed sensing facility is provided as encoder pulses and wherein said target gaps are defined in terms of pulses, said method comprising comparing the counts of encoder pulses of print stroke events with the counts representing said target gaps.

Preferably said printer is provided with a print system into which a message to be printed is loaded, said method comprising programming said print system to determine said target count measures.

Preferably said method further includes determining and storing a maximum difference between said allowable gaps and said actual gaps.

Preferably said method further includes generating an alert in the event said allowable amount of stretch exceeds a defined limit.

In a second aspect the invention provides a printer operable to print in strokes on a substrate passing along a moving line, wherein said printer is configured to apply the method as set forth above.

In a third aspect the invention provides a printer operable to print a message in strokes on a substrate passing in a print direction along a moving line, wherein the printer is operable to receive an indication of an allowable increase in length in the print direction of a message due to an increase in length in the print direction of gaps between successive strokes printed by the printer, to receive an indication of a speed of movement in the print direction of a moving line, to determine from the indication of the speed of movement of the moving line whether an increase in length in the print direction of a message printed by the printer is greater than the allowable increase in length and, if so, to generate an alert.

Preferably said printer comprises a continuous inkjet printer.

BRIEF DESCRIPTION OF THE DRAWINGS

One embodiment of the invention will now be described with reference to the accompanying drawings in which.

DETAILED DESCRIPTION OF WORKING EMBODIMENT

The embodiment described herein is directed to a continuous (CIJ) printer but it will be appreciated, by those skilled in the art, that the invention may be applied to any printer that prints in strokes.

Figure 1:
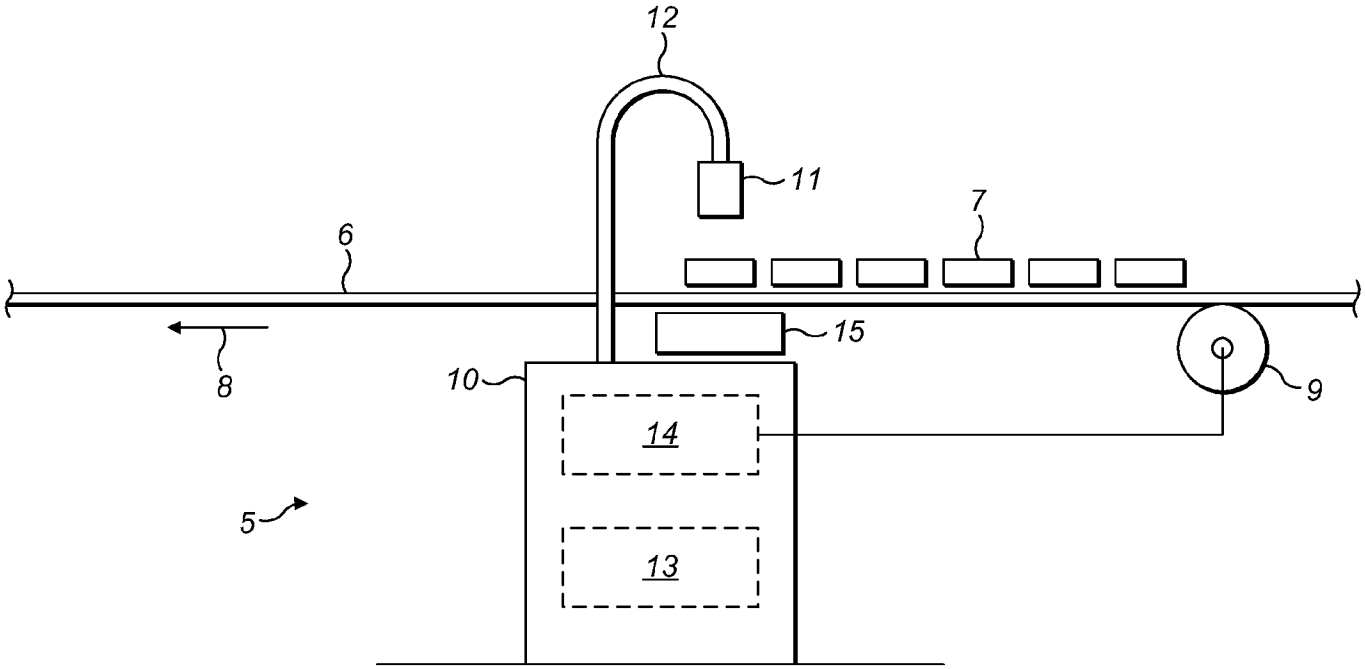
FIG. 1: shows a schematic view of a printer installation to which the invention might be applied.

Referring to FIG. 1, a CIJ printer 5 is shown alongside a moving line 6 on which articles 7, constituting a substrate, are conveyed in the direction of arrow 8. A speed sensing facility such as encoder 9 is provided to output a sequence of pulses representative of the speed of the line 6.

In the conventional manner the CIJ printer 5 comprises a cabinet 10 and a printhead 11 positioned over the line 6 and connected to the cabinet 10 by an umbilical 12. The cabinet 10 contains the usual mechanical system 13 and electronics system 14 that enables the CIJ printer to operate in the known manner, the umbilical 12 circulating ink and make-up between the cabinet and the printhead in the known manner.

A user interface 15, conventionally comprising a screen and a keyboard, is provided to allow data and instructions to be entered into the printer and line speed data is also entered into the electronics system 14 from the encoder 9.

Figure 2:
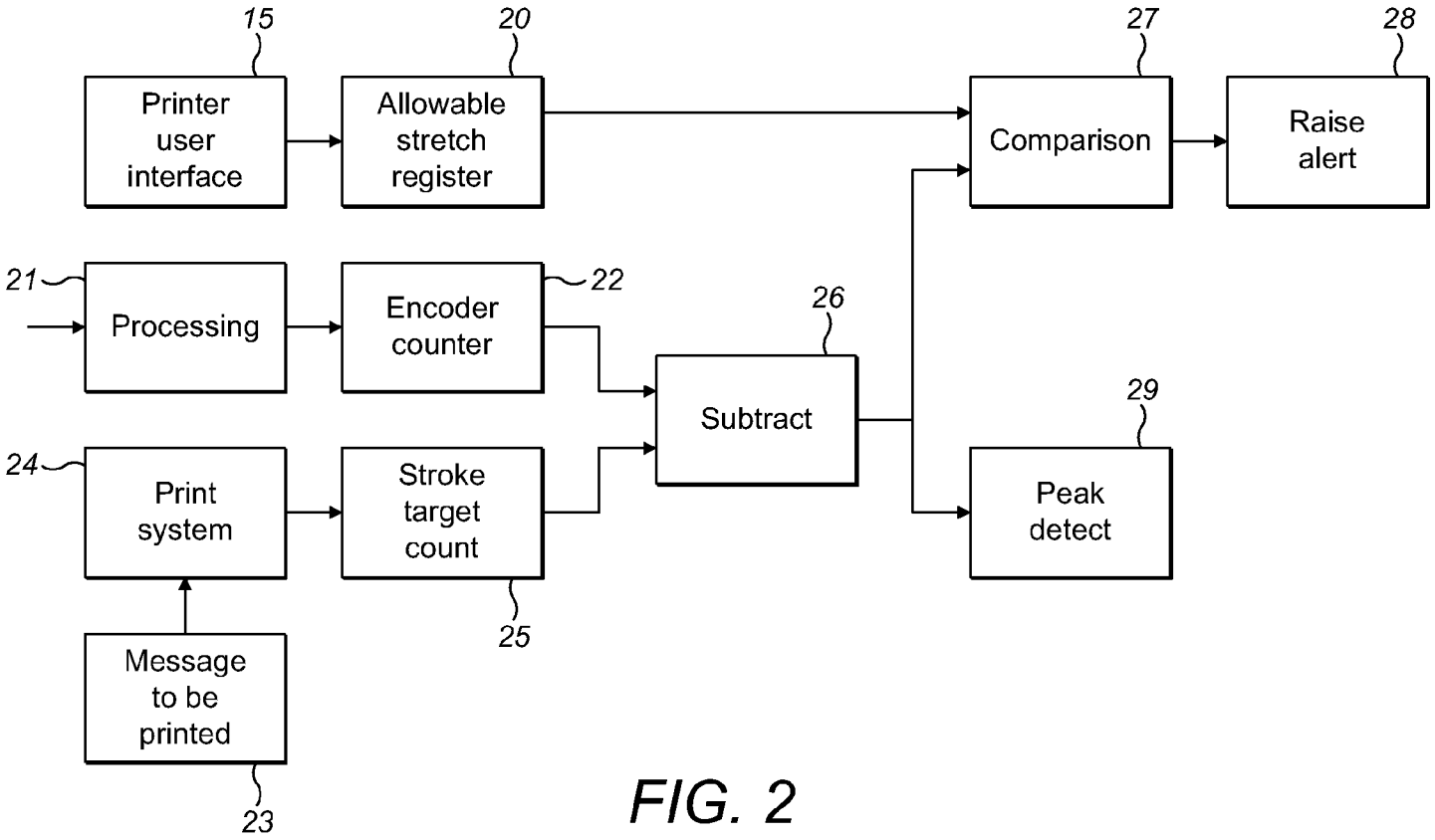
FIG. 2: shows a block diagram of the method steps used to perform the invention.

Turning now to FIG. 2, the invention provides a method which gives a more meaningful alert to a user that print quality has been affected by over-speed situations. In essence the method allows the user to specify an amount of allowable elongation or stretching of a printed message before an alert is raised. Furthermore the user may also be informed of the amount of stretching that has actually been detected to assist with decision-making on how to deal with the alert.

As a first step, the user inputs an amount of allowable elongation or stretch via the user interface 15; this may be in units of distance or encoder-related counts and the value is stored in a register 20 in the electronics system 14 of the printer.

The output signal from encoder 9 is entered and processed at 21, a step which may involve multiplication or division of the encoder frequency, and the resultant signal is then used to increment a counter 22 which represents the distance along the substrate.

The message 23 to be printed on the substrate is loaded into print system 24, the print system analysing the message and establishing a series of charge or voltage values which constitute the vertical drop placements required for each stroke, along with target encoder count values for the horizontal positions of the starts of the strokes which are stored at 25. It will be appreciated that the spacing between strokes may not be constant but may vary according to the message which may contain segments at different pitches.

The encoder counter 22 and the stroke target count 25 are continually compared/subtracted at step 26 and the result is presented to a comparator 27. If the encoder counter 22 is larger than the stroke target 25 by an amount greater than the allowable stretch entered at 20, then an alert is raised at step 28.

The output of the subtract step 26 may also be fed into a peak detector 29 which records the maximum level of stretch observed since the value was last read by the electronics system 14. The value of peak detection may be used alongside the alert notification to give the user an indication of the actual stretch amount seen.

Figure 3A:
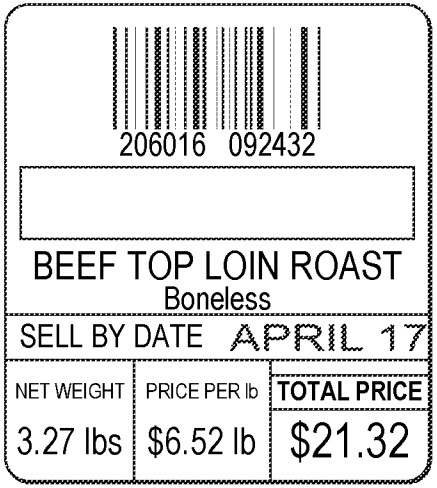
FIGS. 3A to 3C: show examples of acceptable, barely acceptable, and unacceptable stretch of a message.
Figure 3B:
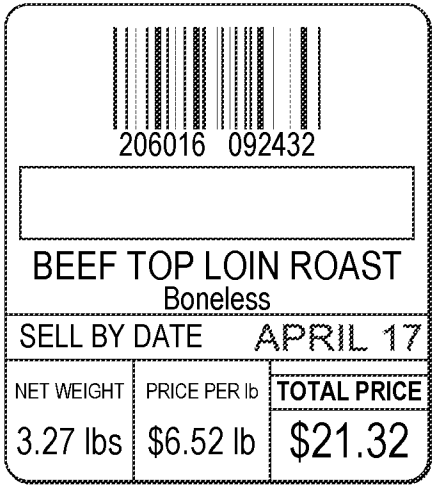
Figure 3C:
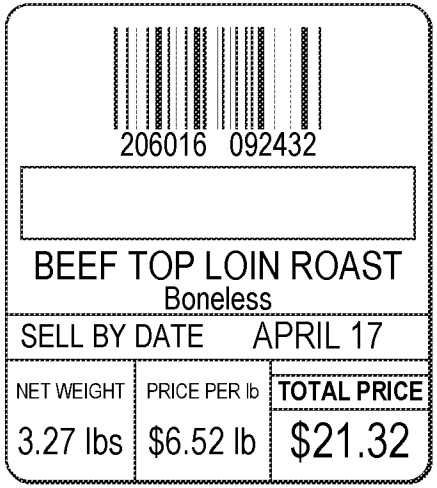

Referring to FIG. 3, the stretch referred to may be better understood by observing the line showing "SELL BY DATE" and the Date "APRIL 17". In FIG. 3A, the date is shown at the correct spacing while in FIG. 3B the spacing, though still acceptable, is stretched toward the edge of the label. FIG. 3C indicates a print that has been stretched beyond an acceptable level and which would incur an alert as described herein.

Having been alerted, a user may then implement a solution. This solution may involve the use of a faster raster or possibly slowing the line speed, the method chosen depending on the nature of compromise that the user is willing to accept.

The invention claimed is:

1. A method of regulating the operation of a printer printing in strokes on a substrate passing along a moving production line in a print direction, said method being characterised in that it includes a user of said printer defining an allowable amount of stretch in said print direction of a message to be printed by said printer.

2. A method as claimed in claim 1 wherein a speed sensing facility is provided giving an output representative of the speed of said moving production line, said method comprising defining, in units corresponding to the output of said speed sensing facility, target gaps between strokes in said print direction; defining an allowable stretch in said message; and comparing the outputs of said speed sensing facility with said target gaps.

3. A method as claimed in claim 2 wherein the output of said speed sensing facility is provided as encoder pulses and wherein said target gaps are defined in terms of pulses, said method comprising comparing the counts of encoder pulses with the counts representing said target gaps.

4. A method as claimed in claim 3 wherein said printer is provided with a print system into which a message to be printed is loaded, said method comprising programming said print system to determine said target count measures.

5. A method as claimed in claim 2 further including determining and storing a maximum difference between the outputs of said speed sensing facility and said target gaps.

6. A method as claimed in claim 1 further including generating an alert in the event said allowable amount of stretch exceeds a defined limit.

7. A printer operable to print in strokes on a substrate passing along a moving production line, wherein said printer is configured to apply the method claimed in claim 1.

8. A printer operable to print a message in strokes on a substrate passing in a print direction along a moving production line, wherein the printer is operable to receive an indication of an allowable increase in length in the print direction of a message due to an increase in length in the print direction of gaps between successive strokes printed by the printer, to receive an indication of a speed of movement in the print direction of a moving production line, to determine from the indication of the speed of movement of the moving line whether an increase in length in the print direction of a message printed by the printer is greater than the allowable increase in length and, if so, to generate an alert.

9. A printer as claimed in claim 8 comprising a continuous inkjet printer.

* * * * *